US006955573B2

(12) United States Patent
Matsuda et al.

(10) Patent No.: US 6,955,573 B2
(45) Date of Patent: Oct. 18, 2005

(54) SMALL WATERCRAFT

(75) Inventors: Yoshimoto Matsuda, Kobe (JP); Yasuo Okada, Akashi (JP)

(73) Assignee: Kawasaki Jukogyo Kabushiki Kaisha, Kobe (JP)

( * ) Notice: Subject to any disclaimer, the term of this patent is extended or adjusted under 35 U.S.C. 154(b) by 0 days.

(21) Appl. No.: 10/635,787

(22) Filed: Aug. 5, 2003

(65) Prior Publication Data

US 2004/0053546 A1 Mar. 18, 2004

(30) Foreign Application Priority Data

Aug. 13, 2002 (JP) ..... 2002-235618

(51) Int. Cl.[7] ..... B63H 21/38
(52) U.S. Cl. ..... 440/88 L; 123/572
(58) Field of Search ..... 440/88 R, 88 A, 440/88 L; 123/41.86, 572, 573, 574, 196 R, 123/196 CP

(56) References Cited

U.S. PATENT DOCUMENTS 2,671,893 A * 3/1954 Van Scoy et al. ..... 123/196 CP
4,674,457 A * 6/1987 Berger et al. ..... 123/196 R
4,856,486 A * 8/1989 Mori et al. ..... 123/572
5,951,343 A * 9/1999 Nanami et al. ..... 440/88 L
6,190,221 B1 * 2/2001 Nanami ..... 440/88 R
6,491,556 B2 * 12/2002 Muramatsu et al. ..... 440/88 R
6,520,164 B1 * 2/2003 Lepp et al. ..... 123/572
6,695,658 B1 * 2/2004 Muramatsu ..... 440/88 L

* cited by examiner

*Primary Examiner*—Andrew D. Wright
(74) *Attorney, Agent, or Firm*—Alleman Hall McCoy Russell & Tuttle LLP

(57) ABSTRACT

A small watercraft including an engine mounted in a body such that an axial direction of a crankshaft corresponds with a longitudinal direction of the body, an oil tank provided such that a longitudinal direction thereof corresponds with the axial direction of the crankshaft, a first communicating port and a second communicating port formed in the oil tank at least two positions spaced apart from each other in the longitudinal direction, a gas-release chamber having a third communicating port and a fourth communicating port provided at two positions spaced apart from each other, and at least one fifth communicating port located to communicate with an ambient side, the gas-release chamber having a bottom face located higher than a liquid level of oil inside the oil tank, wherein the first communicating port communicates with the third communicating port and the second communicating port communicates with the fourth communicating port.

11 Claims, 6 Drawing Sheets

SMALL WATERCRAFT

BACKGROUND OF THE INVENTION

1. Field of the Invention

The present invention relates to a small watercraft such as a personal watercraft (PWC) which ejects water rearward and planes on a water surface as the resulting reaction. More particularly, the present invention relates to a gas-release structure of the engine. As defined herein, the gas refers to a gas containing mist oil or a fuel, or air.

2. Description of the Related Art

In recent years, so-called jet-propulsion personal watercraft, which are one type of small watercraft, have been widely used in leisure, sport, rescue activities, and the like. The jet-propulsion personal watercraft is configured to have a water jet pump that pressurizes and accelerates water sucked from a water intake generally provided on a bottom hull surface and ejects it rearward from an outlet port. Thereby, the personal watercraft is propelled. In the jet-propulsion personal watercraft, a steering nozzle provided behind the outlet port of the water jet pump is swung either to the right or to the left by operating a bar-type steering handle to the right or to the left, to change the ejection direction of the water to the right or to the left, thereby turning the watercraft to the right or to the left.

In the personal watercraft so configured, a multi-cylinder engine is mounted such that a crankshaft extends along the longitudinal direction of a body. In a wet-sump engine, an oil tank is provided on a bottom portion of a crankcase to be integral with the crankcase to allow the oil tank and the crankcase to have a common chamber, while, in a dry-sump engine, a chamber of the oil tank is formed to be independent of a chamber of the crankcase. In both engines, lubricating oil inside the oil tank is fed to components of the engine that require lubrication by using a feed pump or the like.

In these engines, with reciprocation of a piston and by a blow-by gas from a combustion chamber, a pressure inside the crankcase varies. In order to inhibit the reciprocation of a piston of the engine from being impeded due to a variation in the pressure, it is required that the crankcase communicate with an ambient side to allow the variation in the pressure of the crankcase to be lessened. More specifically, in the case of the wet-sump engine, the crankcase communicates with the ambient side through a breather pipe, or the crankcase communicates with a cam chamber of a cylinder head through a cam chain tunnel and the cam chamber communicates with the ambient side through the breather pipe (involving a breather passage) to allow the variation in the pressure of the crankcase to be lessened.

In the case of the dry-sump engine, as in the case of the wet-sump engine, the above breather mechanism is needed. In addition, in the dry-sump engine, since gas (containing the blow-gas) is mixed in the oil being delivered from the chamber of the crankcase by a scavenging pump, the breather mechanism needs to be provided on the chamber of the oil tank independent of the chamber of the crankcase to allow the gas flowing into the chamber of the oil tank to be released to the ambient side.

In the case of the personal watercraft in which the longitudinal direction of the oil tank corresponds with the longitudinal direction of the watercraft (axial direction of the crankshaft of the engine), oil inside the oil tank moves to a front portion or a rear portion due to inertia force while the watercraft is starting and stopping (accelerating or decelerating). Under this condition, the oil is distributed unevenly inside the oil tank, and thereby, an upstream end portion of the breather pipe or a breather hole of the breather mechanism is clogged with the oil. With the breather hole clogged with the oil, the gas inside the oil tank is compressed temporarily, which is caused by reciprocation of the piston or the blow-by gas. For this reason, the oil flows to an outside of the oil tank together with the pressurized gas.

In other operations of the engine, depending on the state of the oil inside the oil tank, the breather pipe or the breather hole is temporarily clogged with the oil. Under this condition, the gas inside the oil tank is temporarily compressed and the oil flows outside the oil tank together with the pressurized gas.

As a solution, a gas-flow cross-sectional area of the breather pipe or the breather hole may be made larger to inhibit clogging. In actuality, however, the gas-flow cross-sectional area needs to be ten to fifteen times larger than that of a normal breather pipe or the like. In the personal watercraft, it is difficult to provide the breather pipe or the breather hole having such a large gas-flow cross-sectional area in a limited space in the vicinity of the engine.

SUMMARY OF THE INVENTION

The present invention addresses the above described condition, and an object of the present invention is to provide a small watercraft capable of smoothly releasing a gas inside an oil tank to an ambient side, even when the oil inside the oil tank moves backward and forward to cause a gas-release hole to be clogged with the oil during acceleration or deceleration of the small watercraft, or the gas-release hole is temporarily clogged with the oil.

According to the present invention, there is provided a small watercraft comprising a multi-cylinder engine mounted in a body of the watercraft such that an axial direction of a crankshaft corresponds with a longitudinal direction of the body; an oil tank provided such that a longitudinal direction thereof corresponds with the axial direction of the crankshaft; a first communicating port and a second communicating port formed in the oil tank at least two positions spaced apart from each other in the longitudinal direction of the oil tank; a gas-release chamber having a third communicating port and a fourth communicating port provided at two positions spaced apart from each other, and at least one fifth communicating port located so as to communicate with an ambient side, the gas-release chamber having a bottom face located higher than a liquid level of oil inside the oil tank, wherein the first communicating port of the oil tank communicates with the third communicating port of the gas-release chamber and the second communicating port of the oil tank communicates with the fourth communicating port of the gas-release chamber.

In accordance with the small watercraft configured as described above, even when the oil moves to the front portion or the rear portion inside the oil tank during acceleration or deceleration of the watercraft, one of the first and second communicating ports located at front and rear positions is not clogged with the oil. Therefore, the pressurized gas is released from the communicating port, which is not clogged with the oil, to the ambient side through the fifth communicating port of the gas-release chamber. For example, during acceleration of the watercraft, the oil moves to the rear portion inside the oil tank due to inertia force, and under this condition, the communicating port on the rear side of oil tank, for example, the second communicating port, is clogged with the oil. In this case, since the communicating port on the front side is not clogged with the oil, the gas inside the oil tank is released from this communicating port to the ambient side through the gas-release chamber. During other operations of the engine, there is little possibility that the two communicating ports are clogged with the oil at the same time. The gas is released from the communicating hole, which is less clogged with the oil to the ambient side, through the fifth communicating port of the gas-release chamber. Once the gas is released from one of the first and second communicating ports, the gas continues to be released from this communicating port to the gas-release chamber, and the oil separated from the gas inside the gas-release chamber is returned to the oil tank from the remaining communicating port. Since a one-way communicating passage is formed in this way, the gas is released smoothly.

Preferably, the third communicating port and the fourth communicating port may be provided at different positions in a vertical direction. In this structure, the oil inside the gas-release chamber is returned to the oil tank through the communicating port located lower, while the watercraft is cruising at a constant speed, and the gas inside the oil tank is released through the communicating port located higher. That is, between the oil tank and the gas-release chamber, a one-way oil return circulating system (passage) is formed by the communicating ports. Therefore, even when the pipes connecting these communicating ports have small cross-sectional areas, an increase in the pressure inside the oil tank is effectively inhibited.

In the above small watercraft, even when a substantial portion of the oil tank is located under a crankcase of the engine, the gas inside the oil tank can be released to the ambient side without a flow of oil to the outside of the oil tank.

In the above small watercraft, even when a chamber of the oil tank is independent of a chamber of the crankcase, the gas inside the oil tank can be released to the ambient side without the flow of the oil to outside of the oil tank.

Preferably, the fifth communicating port of the gas-release chamber may be connected to an upstream end of a breather pipe in a flow of a gas. In this structure, the gas is released from the gas-release chamber to the ambient side through the breather pipe.

Preferably, the small watercraft may further comprise an oil separator connected to a downstream end of the breather pipe, for separating oil from the gas. The oil separator serves to efficiently separate the oil from the gas.

Preferably, the fifth communicating port of the gas-release chamber may be connected to a cylinder head of the engine through the breather pipe to allow an inside of the cylinder head and an inside of the gas-release chamber to communicate with each other.

Preferably, a lower end of at least one of the fifth communicating port of the gas-release chamber, the first communicating port of the oil tank, and the second communicating port of the oil tank may be configured to protrude downwardly from a wall face around the communicating port such that its lower end is lower than the wall face. In this structure, the oil is inhibited from outflowing together with the gas due to difference in mass and viscosity between the oil and the gas.

The above and further objects and features of the invention will be more fully be apparent from the following detailed description with accompanying drawings.

DETAILED DESCRIPTION OF THE PREFERRED EMBODIMENTS

Hereinafter, an embodiment of a personal watercraft, which is one type of a small watercraft, will be described with reference to the drawings.

Figure 5:
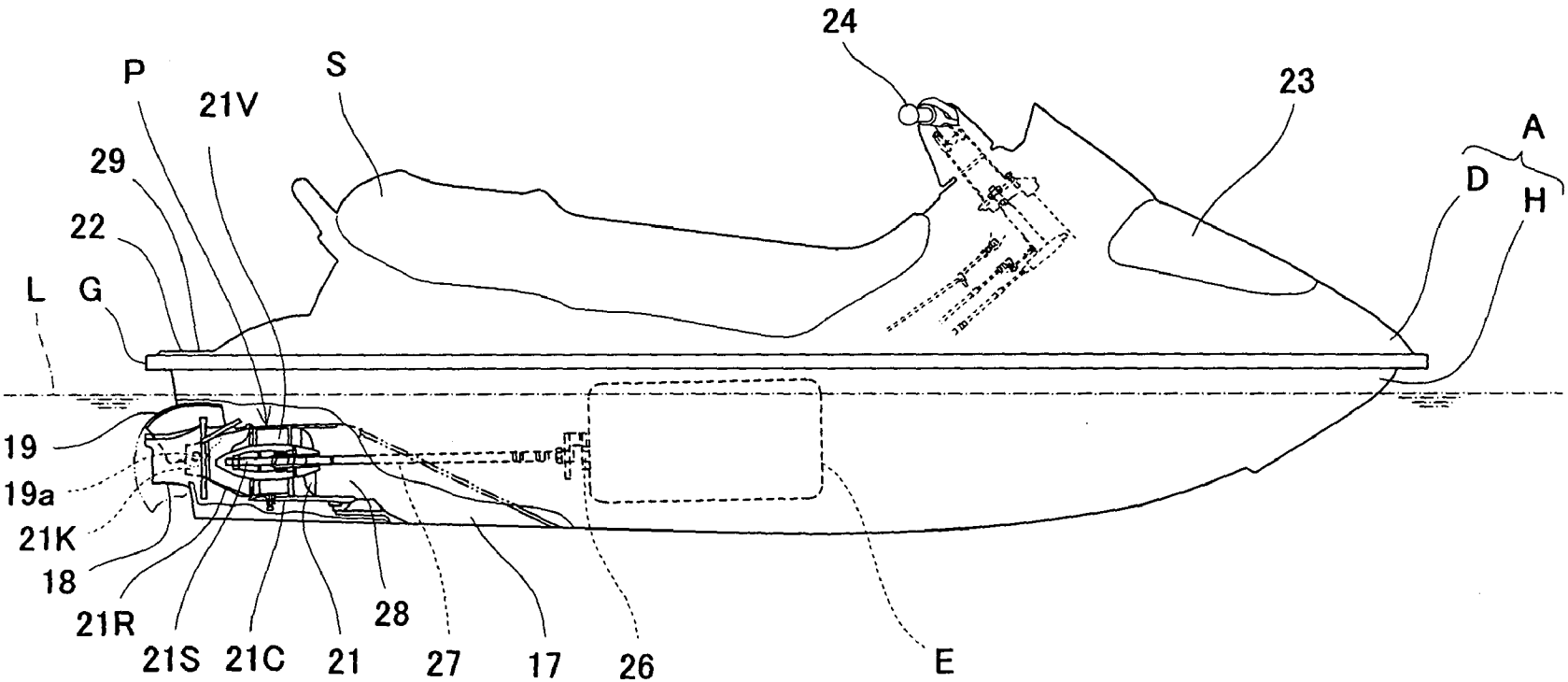
FIG. 5 is a side view showing an entire personal watercraft according to an embodiment of the present invention.
Figure 6:
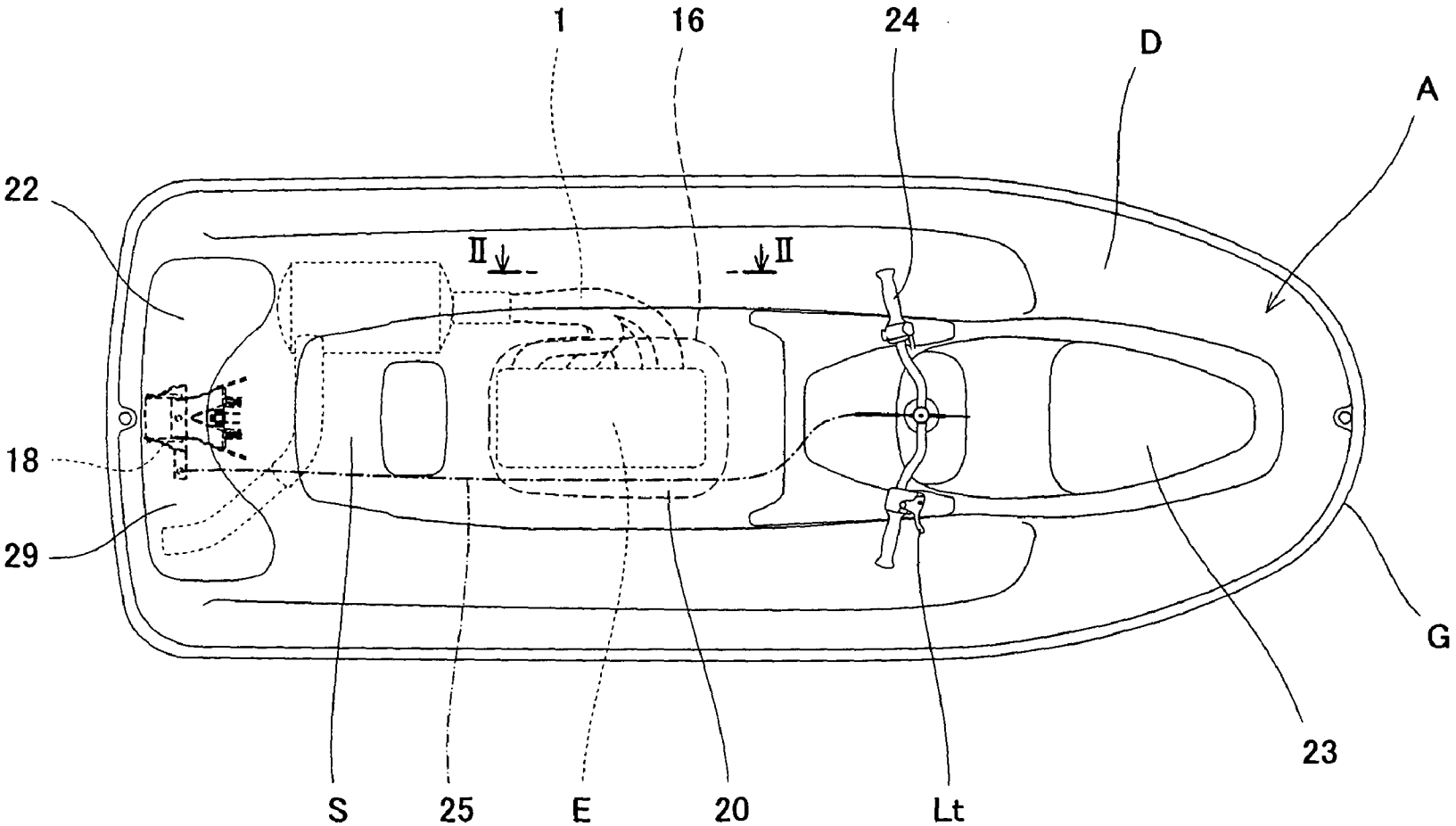
FIG. 6 is a plan view of the personal watercraft in FIG. 5.

In FIGS. 5 and 6, reference numeral A denotes a body of the personal watercraft. The body A comprises a hull A and a deck D covering the hull H from above. A line at which the hull H and the deck D are connected over the entire perimeter thereof is called a gunnel line G. The gunnel line G is located above the waterline L of the personal watercraft.

As shown in FIG. 6, an opening 16, which has a substantially rectangular shape seen from above, is formed at a relatively rear section of the deck D such that it extends in the longitudinal direction of the body A, and a riding seat S is mounted above the opening 16 such that it covers the opening 16 from above as shown in FIGS. 5 and 6.

An engine E is contained in a engine room 20 surrounded by the hull H and the deck D below the seat S and having a convex-shape in a cross section of the body A. In this embodiment, the engine E is a multi-cylinder (four-cylinder) four-cycle engine. As shown in FIG. 5, the engine E is mounted such that a crankshaft 26 is mounted along the longitudinal direction of the body A. An output end of the crankshaft 26 is rotatably coupled integrally with a pump shaft 21S of a water jet pump P through a propeller shaft 27. An impeller 21 is mounted on the output shaft 21S of the water jet pump P. The impeller 21 is covered with a pump casing 21C on the outer periphery thereof. A water intake 17 is provided on the bottom of the hull H. The water is sucked from the water intake 17 and fed to the water jet pump P through a water intake passage 28. The water jet pump P pressurizes and accelerates the water. The pressurized and accelerated water is discharged through a pump nozzle 21R having a cross-sectional area of flow gradually reduced rearward, and from an outlet portion 21K provided on the downstream end of the pump nozzle 21R, thereby obtaining the propulsion force.

In FIG. 5, reference numeral 21V denotes fairing vanes for fairing water flow inside the water jet pump P. In FIGS. 5 and 6, reference numeral 24 denotes a bar-type steering handle. By operating the steering handle 24 to the right or to the left, the steering nozzle 18 provided behind the pump nozzle 21R swings to the right or to the left through a wire cable 25 represented by a dashed line in FIG. 6. The watercraft can be turned to any desired direction while the water jet pump P is generating the propulsion force. A throttle lever Lt in FIG. 6 serves to adjust an engine speed of the engine E.

As shown in FIG. 5, a bowl-shaped reverse deflector 19 is provided above the rear side of the steering nozzle 18 such that it can swing downward around a horizontally mounted swinging shaft 19*a*. The deflector 19 is swung downward toward a lower position behind the steering nozzle 18 to deflect the water ejected from the steering nozzle 18 forward and, as the resulting reaction, the personal watercraft moves rearward.

In FIGS. 5 and 6, reference numeral 22 denotes a rear deck. The rear deck 22 is provided with an operable hatch cover 29. A rear compartment (not shown) with a small capacity is provided under the hatch cover 29. Reference numeral 23 denotes a front hatch cover. A front compartment (not shown) is provided under the front hatch cover 23 for storing equipment and the like.

Figure 1:
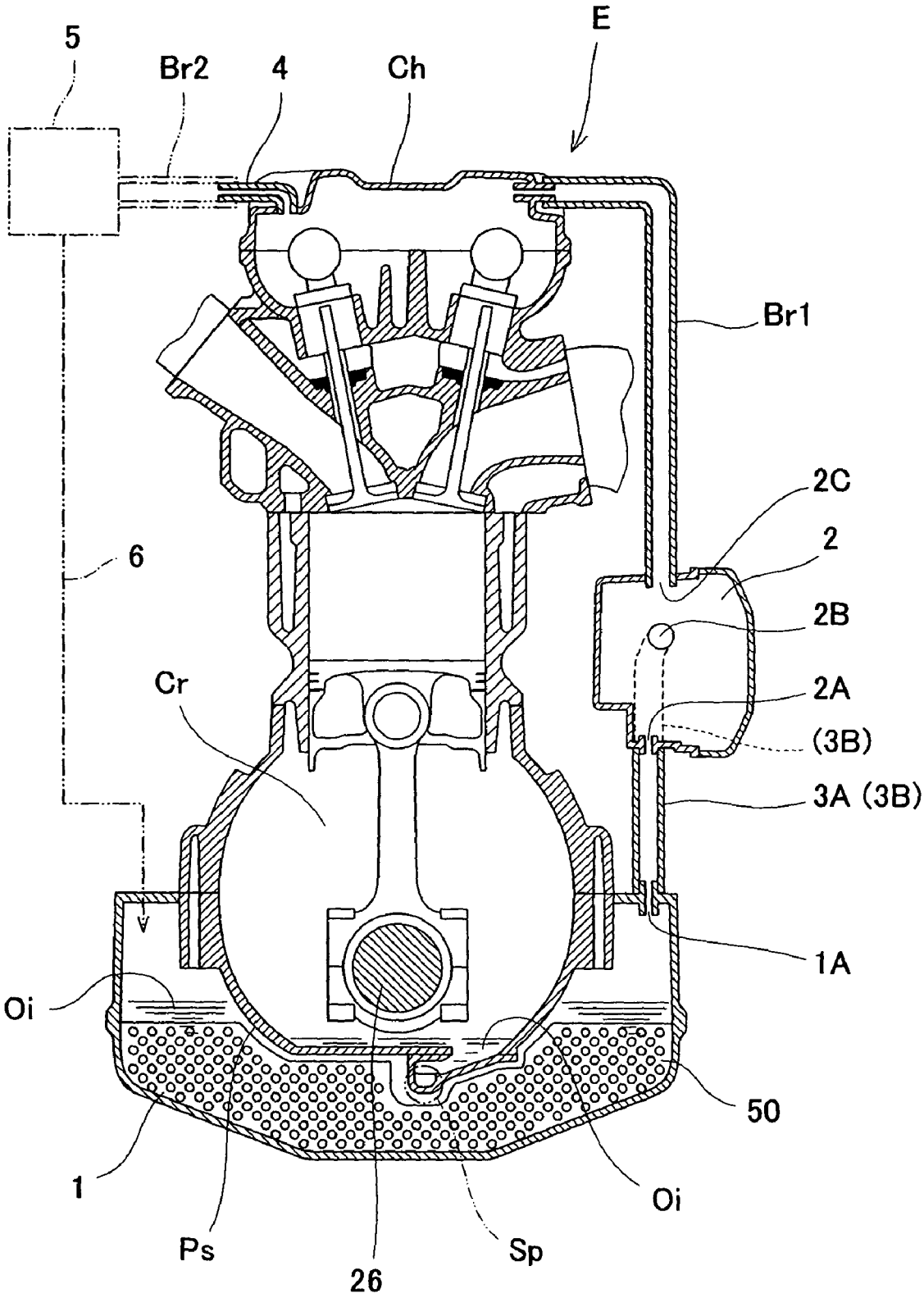
FIG. 1 is a partial cross-sectional view of an engine sectioned along the direction perpendicular to the crankshaft, schematically showing a structure of the engine and a chamber of an oil tank of a personal watercraft which is one type of a small watercraft according to an embodiment of the present invention.
Figure 2:
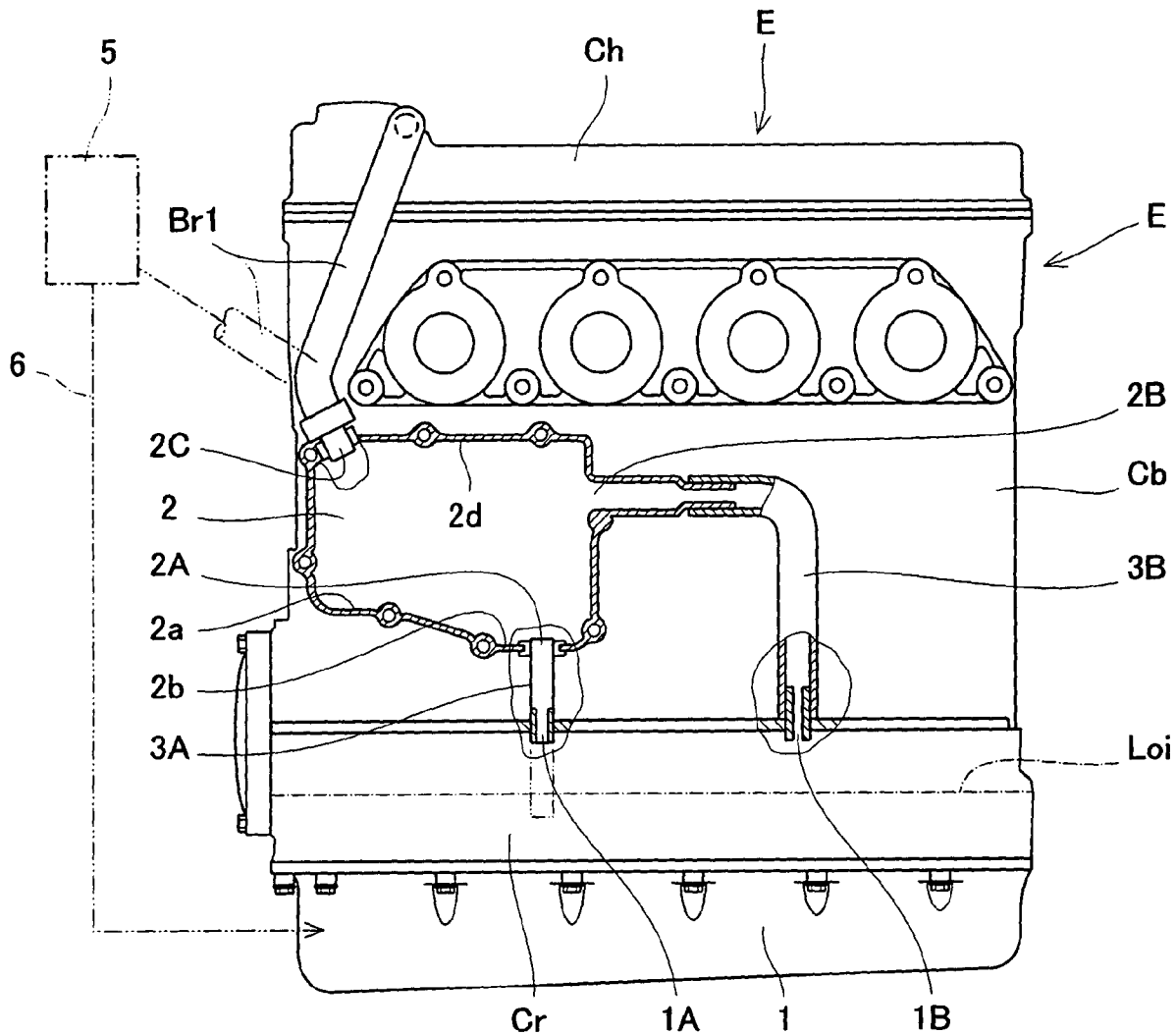
FIG. 2 is a partial cross-sectional view showing a structure of the engine taken in the direction of arrows along line II—II in FIG. 6, i.e., the engine seen from the direction perpendicular to the crankshaft of the engine in FIG. 1.

In the four-cylinder engine of the personal watercraft of the embodiment of the present invention, as shown in FIG. 1, a chamber of an oil tank (oil tank chamber) 1 is provided under a chamber of a crankcase (crankcase chamber) Cr of the engine E such that the longitudinal direction thereof corresponds with the axial direction of the crankshaft 26. In this embodiment, the oil tank chamber 1 is sized to be substantially equal in volume to the crankcase chamber Cr. The oil tank chamber 1 is separated from the crankcase chamber Cr by a separating wall Ps comprised of a U-shaped wall face which forms an inner part of the crankcase. In this embodiment, a substantial portion of the oil tank chamber 1 is located below the engine E. Typically, between about 50 and 100 percent of a width dimension of the oil tank is located below the oil tank chamber, and more typically, about 75 percent of the oil tank width dimension is located below the oil tank chamber, as shown in FIG. 1. This configuration aids in keeping the overall dimensions of the engine compact. In this embodiment, as shown in FIG. 2, a bottom face of the oil tank chamber 1 is inclined such that a rear portion is higher than a front portion with the oil tank chamber 1 mounted in the watercraft. In FIG. 2, left side is a front side of the watercraft (engine) and right side is a rear side of the watercraft.

Inside the oil tank chamber 1, a baffle wall 50 is provided to permit backward and forward flow of the oil, but to inhibit fast flow of the oil.

As shown in FIG. 1, oil Oi, that has lubricated components of the engine E, is reserved in a bottom portion of the crankcase chamber Cr. A scavenging pump Sp is provided on the bottom portion of the crankcase chamber Cr. By the scavenging pump Sp, the oil Oi reserved in the bottom portion of the crankcase chamber Cr is returned to the oil tank chamber 1.

As shown in FIG. 2, the oil tank chamber 1 is provided with gas-release holes 1A and 1B at front and rear portions in the longitudinal direction of the watercraft. The gas-release holes 1A and 1B serve as first and second communicating ports, respectively. More specifically, the gas-release hole 1A extends vertically from an upper face of the front portion of the oil tank chamber 1 and is provided at a location spaced apart substantially ⅓ of the entire length of the oil tank chamber 1 from a front end of the oil tank chamber 1. The gas-release hole 1B extends vertically from an upper face of the rear portion of the oil tank chamber 1 and is provided at a location spaced apart substantially ⅓ of the entire length of the oil tank chamber 1 from a rear end of the oil tank chamber 1.

Figure 4A:
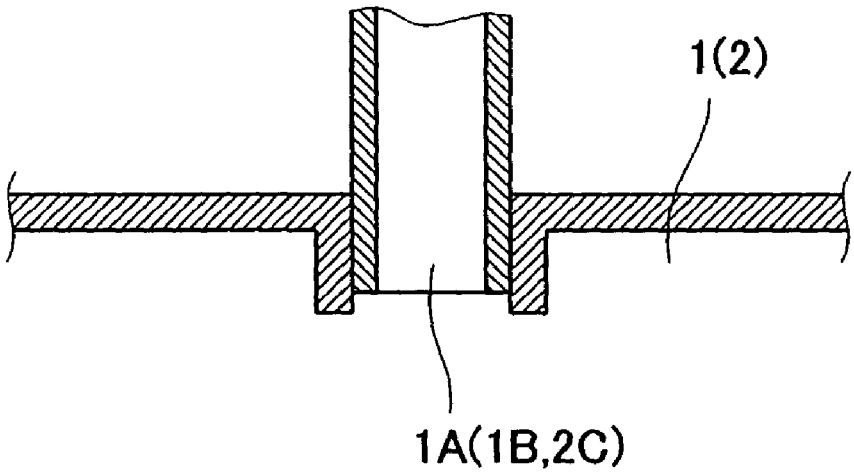
FIG. 4A is a partially enlarged cross-sectional view showing a structure of a gas-release hole of a chamber of an oil tank or a gas-release port of a gas-release chamber.
Figure 4B:
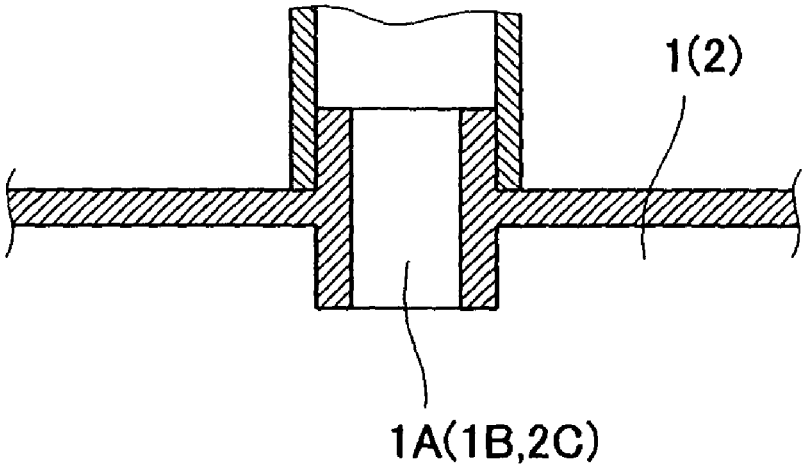
FIG. 4B is a partially enlarged cross-sectional view showing another structure of the gas-release hole of the chamber of the oil tank or the gas-release port of the gas-release chamber.

As shown in FIG. 4B, the gas-release holes 1A and 1B protrude downwardly from a wall face of the oil tank around the holes 1A and 1B such that their lower ends are located lower than the wall face. The structure in FIG. 4B may be replaced by the structure in FIG. 4A. Such a structure is applied to an gas-release hole 2C mentioned later.

Figure 3:
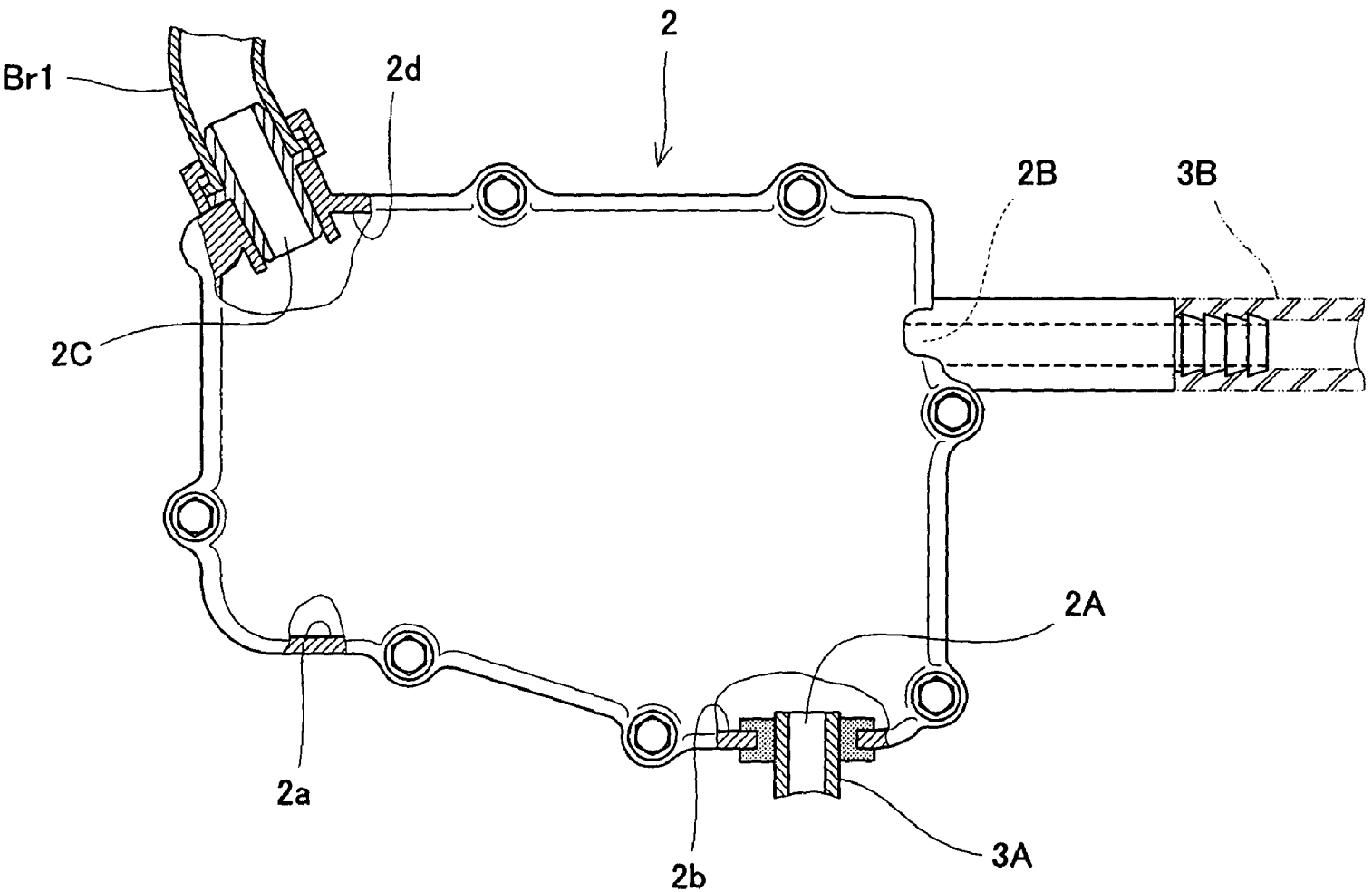
FIG. 3 is a partial cross-sectional enlarged view showing a structure of an gas-release chamber in FIG. 2.

A gas-release chamber 2 for gas release is fixed above the oil tank chamber 1, for example, on a side portion of the cylinder block Cb above the crankcase chamber Cr by means of bolts (not shown). As shown in FIG. 2 or FIG. 3, the gas-release chamber 2 has a deformed rectangle shape in which a right-side portion is extended downwardly, as seen in a side view. More specifically, a bottom portion 2*b* on the right side is located lower than a bottom portion 2*a* on the left side. The gas-release chamber 2 has a single space without a separating wall.

A connecting hole 2A as a third communicating port is vertically provided in the extended downwardly bottom portion 2*b*. The connecting hole 2A is connected to the gas-release hole (first communicating port) 1A of the oil tank chamber 1 through a pipe 3A. A connecting hole 2B as a fourth communicating port is provided to extend in the longitudinal direction as shown in FIG. 2 or in the vertical direction (not shown), or in the width direction (not shown) in the vicinity of the upper end of the side wall of the gas-release chamber 2. The connecting hole 2B is connected to the gas-release hole (second communicating port) 1B of the oil tank chamber 1 through a pipe 3B. The connecting hole 2B is located higher than the connecting hole 2A. The pipe 3B is located on a far side of the gas-release chamber 2 and the pipe 3A in FIG. 1. Alternatively, although not shown, the pipe 3B may deviate from the pipe 3A in the lateral direction in FIG. 1.

A gas-release hole 2C, as a fifth communicating port, is provided in a ceiling wall 2*d* near a side wall on the opposite side of the side wall on which the connecting hole 2B of the gas-release chamber 2 is provided. The gas-release hole 2C extends vertically obliquely. The gas-release hole 2C is connected to the cylinder head Ch of the engine E through a first breather pipe Br1 to allow an inside of the gas-release chamber 2 and an inside of the cylinder head Ch to communicate with each other. As represented by a two-dotted line in FIG. 2, the gas-release hole 2C may be connected to an oil separator 5 through a first breather pipe Br1.

As shown in FIG. 1, a connecting port 4 for gas-release is provided at an upper end of the cylinder head Ch. The connecting port 4 is connected to the oil separator 5 through a second breather pipe Br2. As represented by a two-dotted line in FIG. 1, the oil separator 5 is connected to the oil tank chamber 1 through a return pipe 6. In the same manner, the oil separator 5 represented by a two-dotted line in FIG. 2 is connected to the oil tank chamber 1 through the return pipe 6.

The gas-release holes 1A and 1B are located higher than a liquid level Loi of the oil inside the oil tank chamber 1 when the watercraft is in a steady state. A lower end of the gas-release hole 1A may be located lower than the liquid level Loi inside the oil tank chamber 1 as represented by a two-dotted line in FIG. 2.

In accordance with the personal watercraft configured as described above, when the engine E starts, a pressure inside the crankcase chamber Cr increases due to a blow-by gas from a combustion chamber. The blow-by gas and air in the crankcase chamber Cr are mixed into the oil and are delivered to the oil tank chamber 1 with the oil by using the scavenging pump Sp.

The gas inside the oil tank chamber 1 outflows from the gas-release hole 1A or the gas-release hole 1B into the gas-release chamber 2 through the pipe 3A or the pipe 3B. At this time, due to vibration of the engine E and vibration or the like caused by cruising of the watercraft, the oil inside the oil tank chamber 1 is sometimes changed into a bubbling state. The oil and gas in the bubbling state are delivered into the gas-release chamber 2 through the pipes 3A or 3B.

Since the gas-release chamber 2 has a space larger than those of the pipes 3A and 3B, the oil and the gas are greatly depressurized and the oil is thereby separated from the gas. The separated oil moves toward the bottom portion of the gas-release chamber 2 and flows from the connecting hole 2A provided in the bottom portion through the pipe 3A. The oil is returned to the oil tank chamber 1 through the gas-release hole 1A.

When the oil is returned to the oil tank chamber 1 through the gas-release hole 1A, the gas-release hole 1A is clogged with the oil. However, the gas containing the blow-by gas inside the oil tank chamber 1 is drawn into the gas-release chamber 2 from the gas-release hole 1B with low resistance through the pipe 3B.

As a result, the oil tank chamber 1, the pipe 3B, the gas-release chamber 2, and the pipe 3A form a one-way circulating passage of the oil and, therefore, the oil is smoothly separated from the gas.

While the watercraft is accelerating, the oil inside the oil tank chamber 1 moves to the rear portion due to inertia force. As a result, the gas-release hole 1B is filled or almost filled with the oil and is thereby clogged or almost clogged with the oil. In this situation, the gas is drawn from the gas-release hole 1A provided on the front portion into the gas-release chamber 2 through the pipe 3A.

On the other hand, while the personal watercraft is decelerating, the oil inside the oil tank chamber 1 moves to the front portion due to inertia force. As a result, the gas-release hole 1A is filled or almost filled with the oil and is thereby clogged or almost clogged with the oil. In this situation, the gas is drawn from the gas-release hole 1B provided on the rear portion of the oil tank chamber 1 into the gas-release chamber 2 through the pipe 3B.

In either case, since the gas-release chamber 2 has a space large enough to inhibit the bubbling condition in which the oil contains the gas, which would be caused by the viscosity of the oil and the pressure of the gas, the oil is separated from the gas inside the gas-release chamber 2 . The gas is discharged from the gas-release hole 2C located on the upper side of the gas-release chamber 2, while the oil is smoothly returned to the oil tank chamber 1 located below through either the pipe 3A or the pipe 3B.

As shown in FIG. 4A or 4B, since the gas-release hole 1A, gas-release hole 1B in FIG. 2, and the gas-release hole 2C in FIG. 2 respectively protrude downwardly (inwardly) into the oil tank chamber 1 and the gas-release chamber 2 such that their lower ends are lower than the wall face around them, the oil is inhibited from outflowing toward the pipe 3A or 3B or the breather pipe Br1, together with the gas moving upwardly.

In the case of the personal watercraft as shown in FIG. 1, the oil tank chamber 1 is located lower to be placed in a space below the engine E, a limited space within the engine room is efficiently used.

While in the above embodiment, the oil tank chamber 1 is provided integrally with and below the engine E, the oil tank chamber 1 may be provided at any suitable locations other than below the engine; for example, laterally or forward of the engine, in the case of a dry-sump engine. Alternatively, the oil tank chamber 1 may be provided independently of the engine E.

The present invention is applicable to a "wet-sump" engine in which the bottom portion of the crankcase functions as the oil tank, in addition to the dry-sump engine described so far. In the case of the wet-sump engine, the gas-release hole is provided on a wall face such as a wall face of the upper end portion of the crankcase.

The present invention is applicable to small watercraft other than the personal watercraft.

In the above embodiment, the gas-release port for gas release chamber communicates with an inside of the cylinder head of the engine E through the breather pipe Br1. Alternatively, the breather pipe Br1 may directly communicate with the oil separator 5 as represented by a two-dotted line in FIG. 2. Further, alternatively, the oil separator 5 may be omitted.

While, in the above embodiment, the gas-release chamber 2 is provided above the oil tank chamber 1, the position of the gas-release chamber 2 is not limited to this location. The gas-release chamber 2 may be positioned such that the bottom surface of the gas-release chamber 2 is located above the liquid level of the oil Loi inside the oil tank chamber 1.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A small watercraft comprising:

a multi-cylinder engine mounted in a body of the watercraft such that an axial direction of a crankshaft corresponds with a longitudinal direction of the body;

an oil tank provided such that a longitudinal direction thereof corresponds with the axial direction of the crankshaft;

a first communicating port and a second communicating port formed in the oil tank at respective positions spaced apart from each other in the longitudinal direction of the oil tank;

a gas-release chamber having a third communicating port and a fourth communicating port provided at respective positions spaced apart from each other, and at least one fifth communicating port located so as to communicate with an ambient side, the gas-release chamber having a bottom face located higher than a liquid level of oil inside the oil tank, wherein the first communicating port of the oil tank communicates with the third communicating port of the gas-release chamber through a first passage and the second communicating port of the oil tank communicates with the fourth communicating port of the gas-release chamber through a second passage, and each of the first and second passages is an independent conduit configured to allow the gas containing oil to flow therethrough from the oil tank to the gas-release chamber.

2. The small watercraft according to claim 1, wherein the third communicating port and the fourth communicating port are provided at different positions in a vertical direction.

3. The small watercraft according to claim 1, wherein a substantial portion of the oil tank is located under a crankcase of the engine.

4. The small watercraft according to claim 3, wherein a chamber of the oil tank is fluidically coupled to a chamber of the crankcase.

5. The small watercraft according to claim 4, wherein the chamber of the oil tank is formed adjacent the chamber of the crankcase.

6. The small watercraft according to claim 5, wherein the chamber of the oil tank at least partially borders the chamber of the crankcase.

7. The small watercraft according to claim 1, wherein the fifth communicating port of the gas-release chamber is connected to an upstream end of a breather pipe in a flow of a gas.

8. The small watercraft according to claim 7, further comprising an oil separator connected to a downstream end of the breather pipe, for separating oil from the gas.

9. The small watercraft according to claim 7, wherein the fifth communicating port of the chamber is connected to a cylinder head of the engine through the breather pipe to allow an inside of the cylinder head and an inside of the gas-release chamber to communicate with each other.

10. The small watercraft according to claim 1, wherein a lower end of at least one of the fifth communicating port of the chamber, the first communicating port of the oil tank, and the second communicating port of the oil tank, is configured to protrude downwardly from a wall face around the communicating port such that its lower end is lower than the wall face.

11. A small watercraft comprising:

a multi-cylinder engine mounted in a body of the watercraft such that an axial direction of a crankshaft corresponds with a longitudinal direction of the body;

an oil tank provided such that a longitudinal direction thereof corresponds with the axial direction of the crankshaft;

a first communicating port and a second communicating port formed in the oil tank at respective positions spaced apart from each other in the longitudinal direction of the oil tank; and a gas-release chamber having a third communicating port and a fourth communicating port provided at respective positions spaced apart from each other, and at least one fifth communicating port located so as to communicate with an ambient side, the gas-release chamber having a bottom face located higher than a liquid level of oil inside the oil tank;

wherein the first communicating port of the oil tank communicates with the third communicating port of the gas-release chamber and the second communicating port of the oil tank communicates with the fourth communicating port of the gas-release chamber and wherein the fifth communicating port of the chamber is connected to a cylinder head of the engine through the breather pipe to allow an inside of the cylinder head and an inside of the gas-release chamber to communicate with each other.

* * * * *